US012342924B2

(12) United States Patent
Fang et al.

(10) Patent No.: US 12,342,924 B2
(45) Date of Patent: Jul. 1, 2025

(54) HAIR STRAIGHTENER CAPABLE OF AUTOMATICALLY DISTINGUISHING DRY AND WET HAIR

(71) Applicant: ZHEJIANG YUELI ELECTRICAL CO., LTD., Zhejiang Province (CN)

(72) Inventors: Guohong Fang, Zhejiang Province (CN); Yong Li, Zhejiang Province (CN); Wenfei Xie, Zhejiang Province (CN)

(73) Assignee: ZHEJIANG YUELI ELECTRICAL CO., LTD., Zhejiang Province (CN)

( * ) Notice: Subject to any disclaimer, the term of this patent is extended or adjusted under 35 U.S.C. 154(b) by 685 days.

(21) Appl. No.: 17/681,524

(22) Filed: Feb. 25, 2022

(65) Prior Publication Data

US 2023/0180904 A1 Jun. 15, 2023

(30) Foreign Application Priority Data

Dec. 9, 2021 (CN) ..... 202111503714.0

(51) Int. Cl.
*A45D 2/00* (2006.01)
*A45D 1/28* (2006.01)
*A45D 6/20* (2006.01)

(52) U.S. Cl.
CPC ..... *A45D 6/20* (2013.01); *A45D 1/28* (2013.01); *A45D 2/001* (2013.01)

(58) Field of Classification Search
CPC ..... A45D 2/001; A45D 2/002; A45D 2/00; A45D 2/04; A45D 2/06; A45D 2/08;
(Continued)

(56) References Cited

U.S. PATENT DOCUMENTS 3,745,306 A * 7/1973 Naritomi ..... F24H 1/00 392/404
2004/0194541 A1* 10/2004 Sherman ..... G01N 22/04 73/73

(Continued)

FOREIGN PATENT DOCUMENTS

GB 2600470 A * 5/2022 ..... A45D 1/04

OTHER PUBLICATIONS

Clarivate Analytics copyrighted translation of KR200466782Y1; publication date May 7, 2013 (Year: 2013).*

(Continued)

*Primary Examiner* — Jacqueline T Johanas
*Assistant Examiner* — Sarah Woodhouse
(74) *Attorney, Agent, or Firm* — Clement Cheng

(57) ABSTRACT

The invention discloses a hair straightener capable of automatically distinguishing dry and wet hair. The hair straightener comprises two heating panels, each of the two heating panels having a heating surface, the two heating surfaces cooperating with each other for clasping hair and for hair styling; a conduction assembly, provided in one of the two heating panels, and configured to detect the humidity of hair; and a circuit control system for controlling temperatures of the two heating panels upon receipt of the humidity of the hair detected by the conduction assembly. According to the invention, the temperature of the heating panels can be adjusted to an appropriate temperature after the humidity of the hair is detected, so that the hair conditions are in the best state.

8 Claims, 5 Drawing Sheets

(58) Field of Classification Search
CPC ..... A45D 2/02; A45D 2002/003; A45D 1/00; A45D 1/02; A45D 1/04; A45D 1/06; A45D 1/08; A45D 1/16; A45D 1/28; A45D 1/14; A45D 1/12; A45D 1/10; A45D 2001/045; A45D 2001/004; A45D 2001/006; A45D 2001/008
USPC ..... 219/221–229
See application file for complete search history.

(56) References Cited

U.S. PATENT DOCUMENTS

| | | | | |
|---|---|---|---|---|
| 2007/0267037 | A1* | 11/2007 | Hur | A45D 1/04 132/232 |
| 2015/0173480 | A1* | 6/2015 | Washington | A45D 7/06 206/581 |
| 2021/0307472 | A1* | 10/2021 | Conrad | A45D 20/50 |
| 2022/0007809 | A1* | 1/2022 | Wang | A45D 20/12 |
| 2024/0276605 | A1* | 8/2024 | Weatherly | H05B 1/0252 |

OTHER PUBLICATIONS

Clarivate Analytics copyrighted translation of KR20190000766U; publication date Mar. 26, 2019 (Year: 2019).*
Clarivate Analytics copyrighted translation of KR20200114728A; publication date Oct. 7, 2020 (Year: 2020).*
Clarivate Analytics copyrighted translation of EP2676568B1; publication date Jan. 3, 2018 (Year: 2018).*

* cited by examiner

HAIR STRAIGHTENER CAPABLE OF AUTOMATICALLY DISTINGUISHING DRY AND WET HAIR

BACKGROUND OF THE INVENTION

1. Field of the Invention

The invention relates to the technical field of hair straighteners, and more particularly, to a hair straightener capable of automatically distinguishing dry and wet hair.

2. Description of the Related Art

A conventional dry/wet hair straightener comprises a housing, a power line plug, a heating structure, heating panels for exhausting steam and a switch operating system. The hair straightener has an elegant appearance, and it is easy to operate with such a hand-held device. The power line plug meets security requirements, and it is connected to a power supply for powering the hair straightener. The heating structure is converted into heat energy for model styling. The heating panels for exhausting steam are configured to emit steam generated from the wet hair. Due to the fact that the product is used in different environment for different consumers at different climates, the product needs to be set at different operating temperatures, so that the product can be suitable for different hair types, and on/off of the power supply of the product can be controlled.

However, the conventional dry/wet hair straightener has the following problems: as a hand-held product, the conventional dry/wet hair straightener has only one working mode when it is used to care dry or wet hair. If you get your dry hair straightened, the product is in the best working state. However, if you get your wet hair straightened, the product is not in the best state, then it is impossible for you to have your hair straightened as desired, it may damage the hair, and vice versa. Therefore, the hair straightener is not able to function fully.

SUMMARY OF THE INVENTION

Given that the foregoing problems exist in the prior art, the present invention provides a hair straightener capable of automatically distinguishing dry and wet hair. Upon detection of the humidity of hair, the temperature of heating panels are adjusted to be the appropriate temperature, so as to keep the hair in the best state.

The detailed technical solution is as follows:

a hair straightener capable of automatically distinguishing dry and wet hair, comprising:

two heating panels, each of the two heating panels having a heating surface, the two heating surfaces cooperating with each other for clasping hair and for hair styling;

a conduction assembly, provided in one of the two heating panels, and configured to detect the humidity of hair; and a circuit control system for controlling temperatures of the two heating panels upon receipt of the humidity of the hair detected by the conduction assembly.

In the hair straightener capable of automatically distinguishing dry and wet hair as described above, wherein the conduction assembly at least partially penetrates the heating surface of the one of the two heating panels, and the conduction assembly is in contact with the hair.

In the hair straightener capable of automatically distinguishing dry and wet hair as described above, wherein the heating surface of the one of the two heating panels is set to be insulated.

In the hair straightener capable of automatically distinguishing dry and wet hair as described above, wherein the conduction assembly comprises: at least one first metal piece and at least one second metal piece, wherein the first metal piece is isolated from the second metal piece and the one of the two heating panels, respectively, the second metal piece is in contact with the one of the two heating panels, at least a portion of the first metal piece, and at least a portion of the second metal piece are in contact with the hair, respectively, the first metal piece and the one of the two heating panels are electrically connected to the circuit control system, respectively, the circuit control system determines the humidity of the hair by detecting resistance values between the first metal piece and the second metal piece, and controls the temperatures of the two heating panels.

In the hair straightener capable of automatically distinguishing dry and wet hair as described above, wherein the conduction assembly further comprises: an insulator, arranged in the one of the two heating panels, between the first metal piece and the second metal piece, wherein the first metal piece is isolated from the second metal piece and the one of the heating panels through the insulator, respectively.

The hair straightener capable of automatically distinguishing dry and wet hair further comprises at least one thermostat electrically connected to the circuit control system.

The hair straightener capable of automatically distinguishing dry and wet hair further comprises two brackets, the two brackets are arranged inside the two heating panels respectively, the two brackets are in contact with the two heating panels, respectively, the bracket in one of the heating panels is electrically connected to the circuit control system.

In the hair straightener capable of automatically distinguishing dry and wet hair as described above, wherein the circuit control system controls temperatures of the two heating panels in real time upon receipt of the humidity of the hair detected by the conduction assembly.

The hair straightener capable of automatically distinguishing dry and wet hair further comprises two heaters, wherein the two heaters are arranged inside the two heating panels respectively, the two heaters are in contact with the two brackets, the two heating panels.

The hair straightener capable of automatically distinguishing dry and wet hair further comprises a dry/wet mode selection button, wherein the dry/wet mode selection button is electrically connected to the circuit control system.

The technical solution has the following beneficial effects when compared with the prior art:

after hair of a user is clamped between the two heating panels, the first metal piece and the second metal piece are in contact with the hair, respectively, the second metal piece, the heating panels and the brackets are in contact with each other to form an electrically conductive path. Resistance values of the heating panels and the first metal piece are varied depending on the dryness condition of the hair. Hair moisture content is determined upon detection of the resistance values of the heating panels and the first metal piece by the circuit control system. Upon detection of the humidity of hair, the temperatures of heating panels are adjusted to be the appropriate temperature, so as to keep the hair in the best state.

in the accompanying drawings: 1, heating panel; 2, conduction assembly; 3, circuit control system; 4, heating surface; 5, first metal piece; 6, second metal piece; 7, insulator; 8, thermostat; 9, bracket; 10; heater; 11, dry/wet mode selection button; 12, accommodating space; 13, through groove; 14, barrier strip; 15, step; 21, handle, 22, handle cover; 23, heat insulation sleeve; 24, handle inner sleeve; 25 cycle temperature adjustment button; 26, power button; 27 floating pressure spring; 28, light guide sheet; 29, sealing silica gel; 30, pressing plate; 31, screw cover; 32, junction box; 33, lock ring; 34, power line; 35, push cover; 36, push cover pressing plate; 37, decorative sheet.

DETAILED DESCRIPTION

The present invention will now be described more fully hereinafter with reference to the accompanying drawings and exemplary embodiments, however, the invention is not limited thereto.

Figure 1:
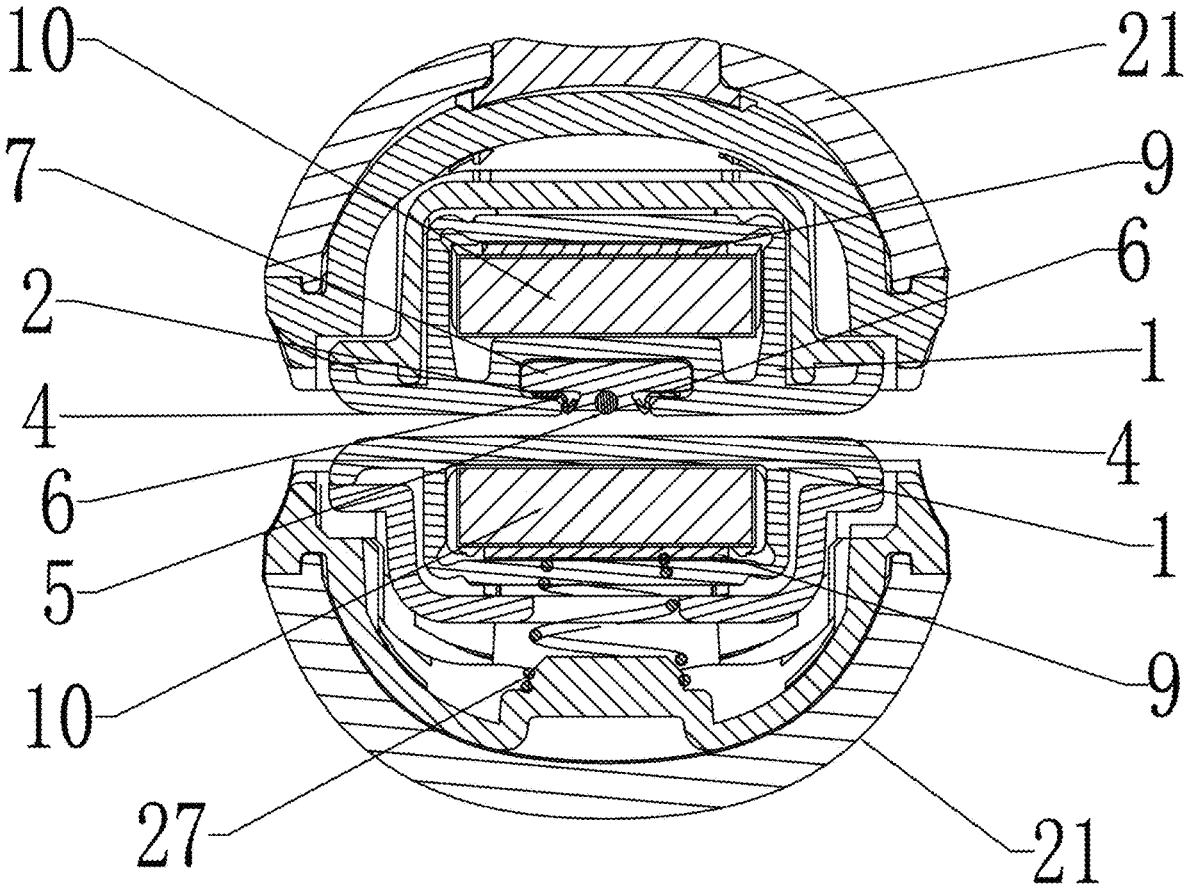
FIG. 1 is a sectional view illustrating an overall structure of a hair straightener capable of automatically distinguishing dry and wet hair along a width direction according to the present invention.
Figure 2:
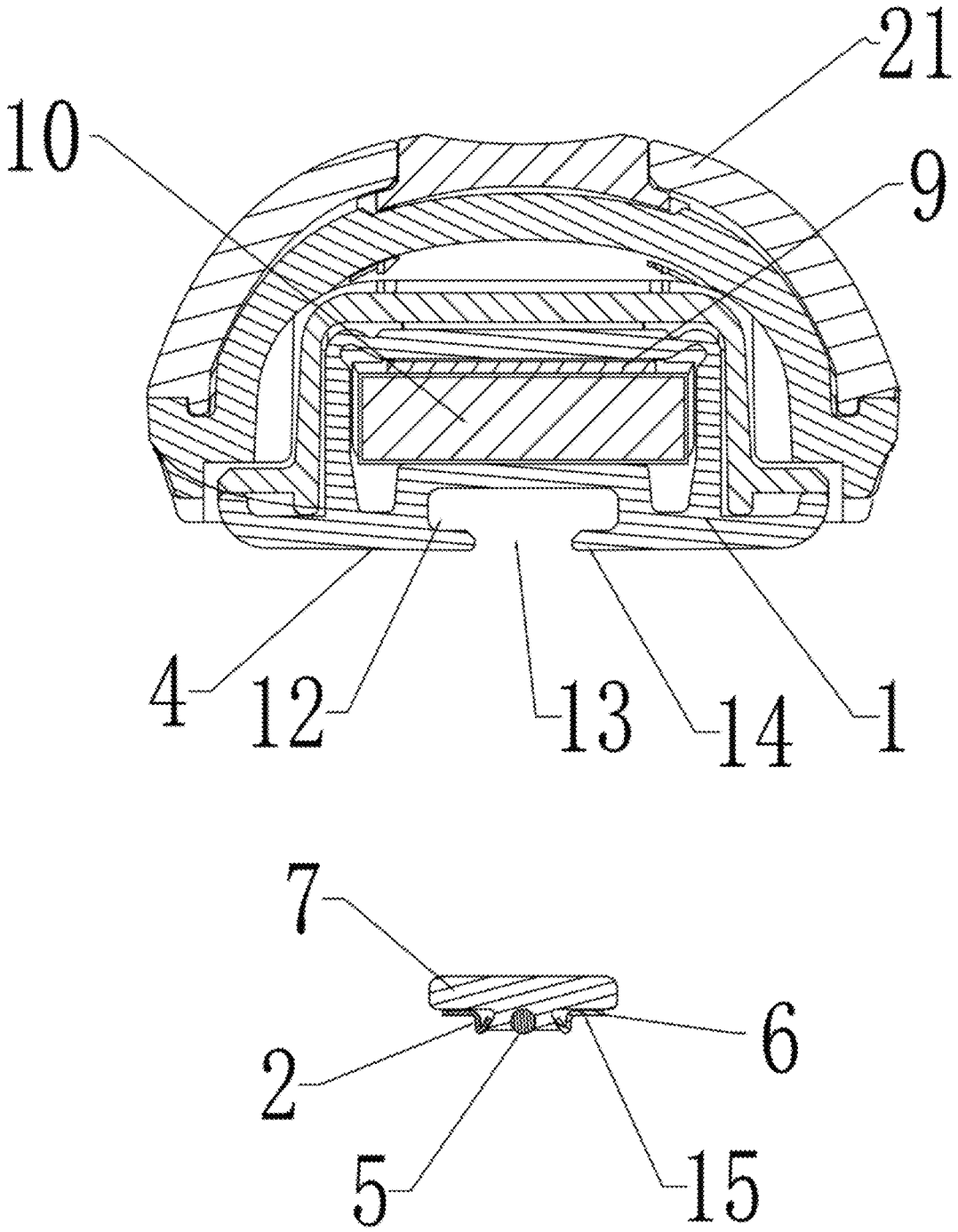
FIG. 2 is a partial exploded view of the hair straightener capable of automatically distinguishing dry and wet hair in FIG. 1 according to the present invention.
Figure 3:
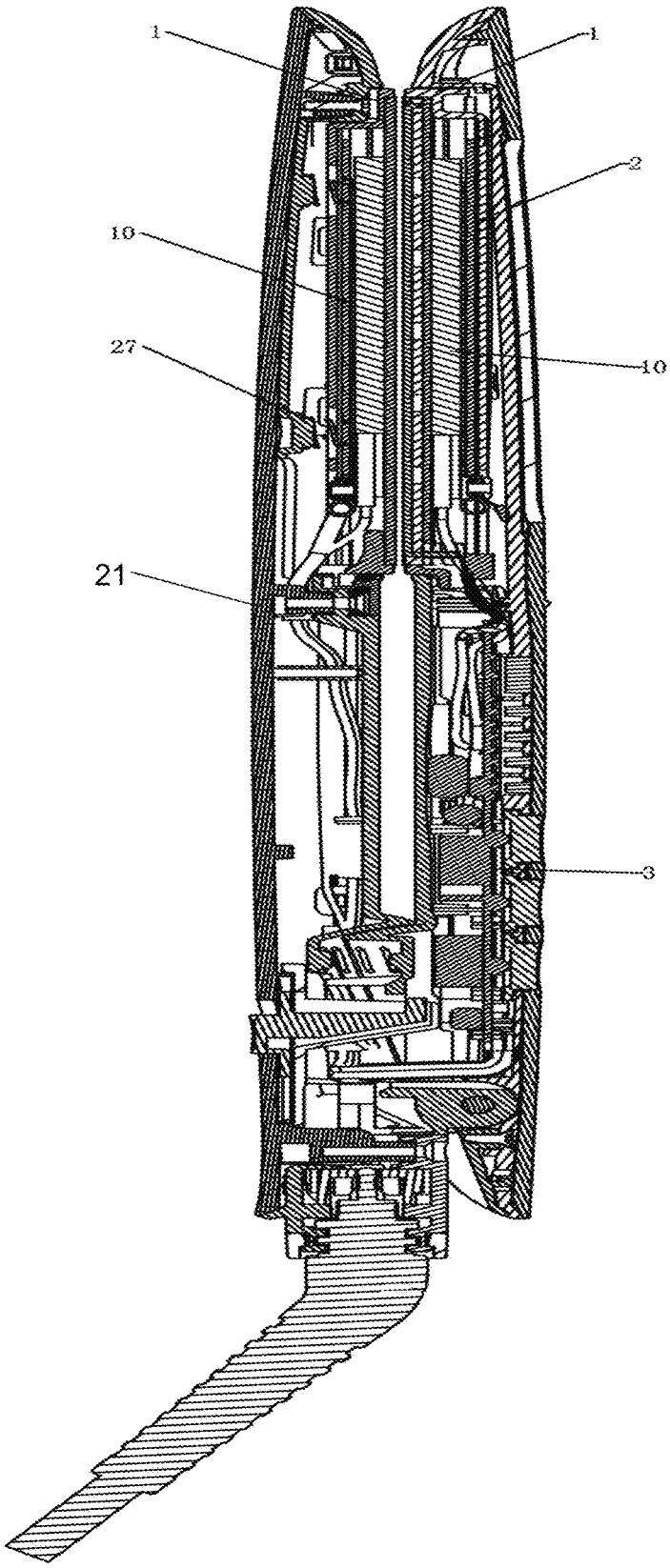
FIG. 3 is a sectional view illustrating an overall structure of a hair straightener capable of automatically distinguishing dry and wet hair along a length direction according to the present invention.
Figure 4:
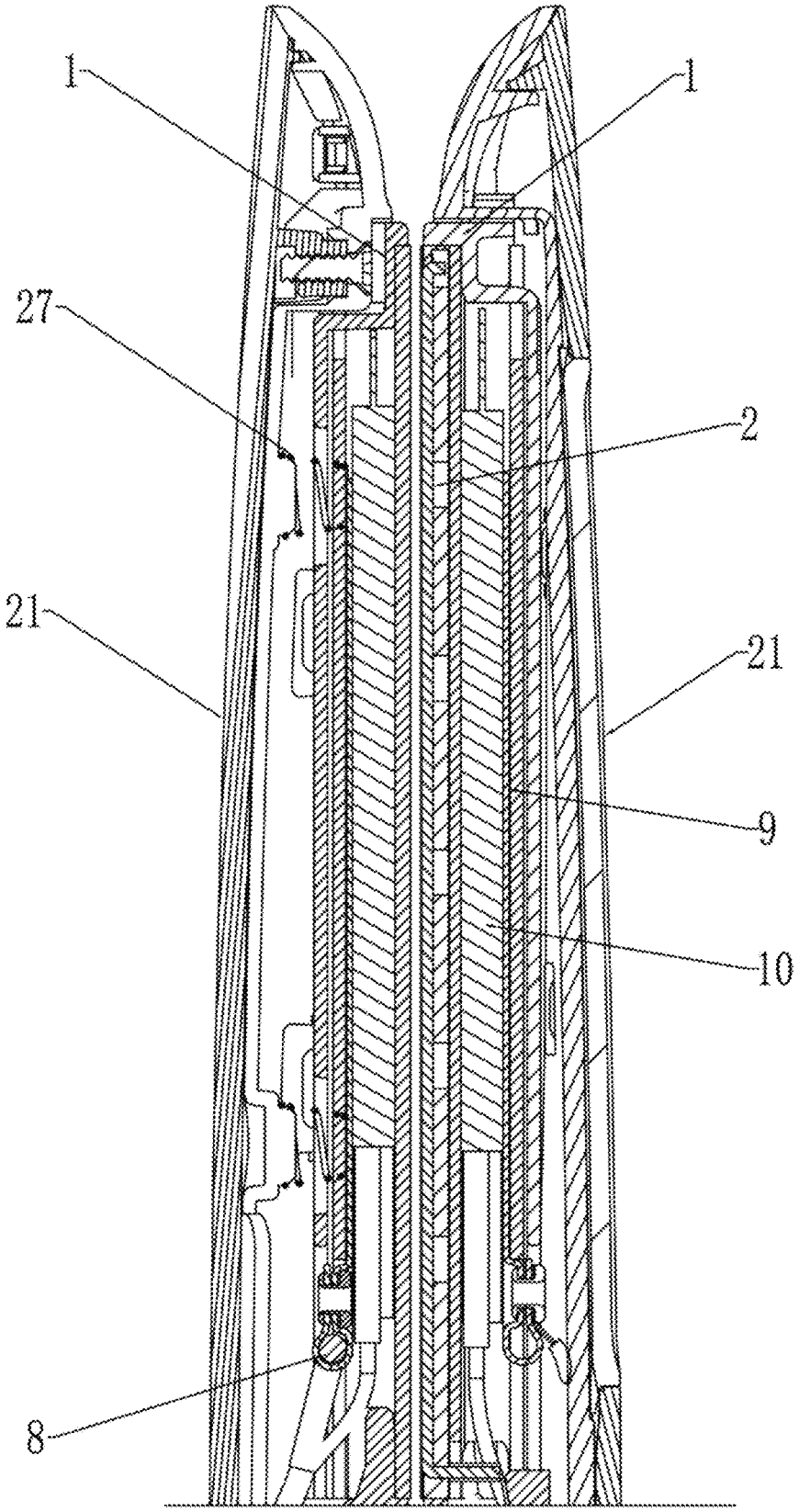
FIG. 4 is a partial enlarged view of the hair straightener capable of automatically distinguishing dry and wet hair in FIG. 3 according to the present invention.
Figure 5:
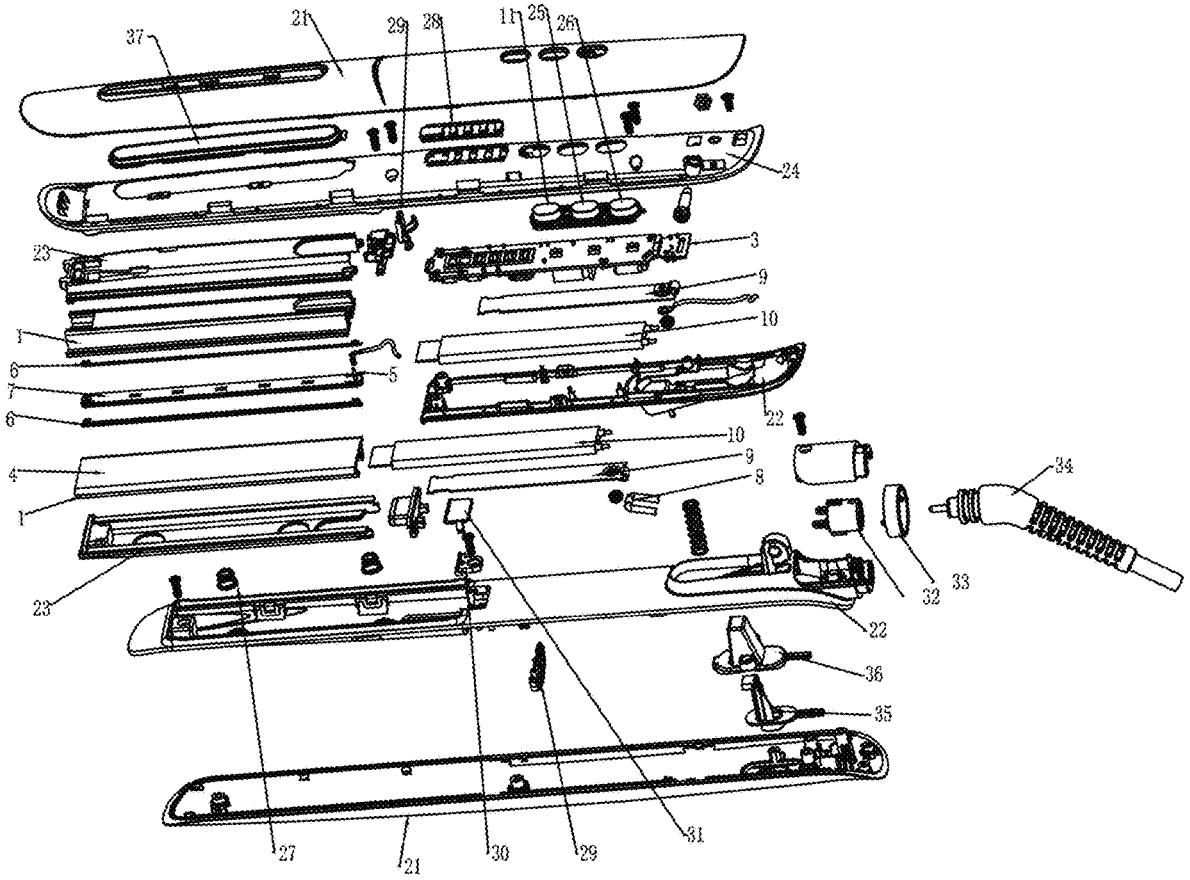
FIG. 5 is a schematic view of an exploded structure of a hair straightener capable of automatically distinguishing dry and wet hair according to the present invention.

FIG. 1 is a sectional view illustrating an overall structure of a hair straightener capable of automatically distinguishing dry and wet hair along a width direction according to the present invention; FIG. 2 is a partial exploded view of the hair straightener capable of automatically distinguishing dry and wet hair in FIG. 1 according to the present invention; FIG. 3 is a sectional view illustrating an overall structure of a hair straightener capable of automatically distinguishing dry and wet hair along a length direction according to the present invention; FIG. 4 is a partial enlarged view of the hair straightener capable of automatically distinguishing dry and wet hair in FIG. 3 according to the present invention; and FIG. 5 is a schematic view of an exploded structure of a hair straightener capable of automatically distinguishing dry and wet hair according to the present invention. FIGS. 1-5 show a hair straightener capable of automatically distinguishing dry and wet hair, comprising: two heating panels 1, each of the two heating panels 1 having a heating surface 4, the two heating surfaces 4 cooperating with each other for clasping hair and for hair styling; a conduction assembly 2, provided in one of the two heating panels 1, and configured to detect the humidity of hair; and a circuit control system 3 for controlling temperatures of the two heating panels 1 upon receipt of the humidity of the hair detected by the conduction assembly 2.

Furthermore, as one of the preferred embodiments, the conduction assembly 2 at least partially penetrates the heating surface 4 of the one of the two heating panels 1, and the conduction assembly 2 is in contact with the hair.

Furthermore, as one of the preferred embodiments, the heating surface 4 of the one of the two heating panels 1 is set to be insulated.

Preferably, the heating surface of the one of the heating panels 1 is not electrically conductive after being coated with ceramic paint.

Furthermore, as one of the preferred embodiments, the conduction assembly 2 comprises: at least one first metal piece 5 and at least one second metal piece 6, wherein the first metal piece 5 is isolated from the second metal piece 6 and the one of the two heating panels 1, respectively, the second metal piece 6 is in contact with the one of the two heating panels 1, at least a portion of the first metal piece 5 and at least a portion of the second metal piece 6 are in contact with the hair, respectively, the first metal piece 5 and the one of the two heating panels 1 are electrically connected to the circuit control system 3, respectively, the circuit control system 3 determines the humidity of the hair by detecting resistance values between the first metal piece 5 and the second metal piece 6, and controls the temperatures of the two heating panels 1.

Furthermore, as one of the preferred embodiments, the conduction assembly 2 further comprises: an insulator 7, arranged in the one of the two heating panels 1, between the first metal piece 5 and the second metal piece 6, wherein the first metal piece 5 is isolated from the second metal piece 6 and the one of the heating panels 1 through the insulator 7, respectively.

Preferably, the insulator 7 is insulating plastics.

Furthermore, as one of the preferred embodiments, the hair straightener capable of automatically distinguishing dry and wet hair further comprises at least one thermostat 8 electrically connected to the circuit control system 3. Preferably, the thermostat 8 is in insulated contact with the heating panels 1 to sense the temperature. Then a temperature signal is fed back to a circuit, and the circuit control system 3 controls a temperature of the heater 10.

Preferably, the thermostat 8 is an NTC thermostat.

Furthermore, as one of the preferred embodiments, the hair straightener capable of automatically distinguishing dry and wet hair further comprises two brackets 9, the two brackets 9 are arranged inside the two heating panels 1, respectively, the two brackets 9 are in contact with the two heating panels 1, respectively, the bracket 9 in one of the two heating panels 1 is electrically connected to the circuit control system 3.

Furthermore, as one of the preferred embodiments, the circuit control system 3 controls temperatures of the two heating panels 1 in real time upon receipt of the humidity of the hair detected by the conduction assembly 2.

Furthermore, as one of the preferred embodiments, the hair straightener capable of automatically distinguishing dry and wet hair further comprises two heaters 10, wherein the two heaters 10 are arranged inside the two heating panels 1 respectively, the two heaters 10 are in contact with the two brackets 9, the two heating panels 1.

Preferably, the heaters 10 are PTC heaters.

Furthermore, as one of the preferred embodiments, the hair straightener capable of automatically distinguishing dry and wet hair further comprises a dry/wet mode selection button 11, wherein the dry/wet mode selection button 11 is electrically connected to the circuit control system 3.

Preferably, the first metal piece 5 is coated with the insulator 7, and the second metal piece 6 is located between the insulator 7 and the heating panels 1.

Preferably, the first metal piece 5 is within the insulator 7, the first metal piece 5 partially penetrates through the insulator 7, and a portion on the first metal piece 5 and a portion on the second metal piece 6 are in contact with the hair, respectively.

Preferably, one side of the first metal piece 5 closing to the heating surface 4, and one side of the second metal piece 6 closing to the heating surface 4 are in contact with the hair, respectively.

Preferably, the one of the two heating panels 1 has an accommodating space 12, the accommodating space 12 extends to the heating surface 4 of the heating panel 1 through a through groove 13, all of the second metal piece 6, the insulator 7 and the first metal piece 5 are in the accommodating space 12, and the first metal piece 5 and the second metal piece 6 extend toward the through groove 13.

Preferably, the first metal piece 5 and the second metal piece 6 are arranged in a long strip shape, and they are both arranged along a length direction of the heating panel 1.

Preferably, two ends of the first metal piece 5 and two ends of the second metal piece 6 have upwraping portions to facilitate installation.

Preferably, the first metal piece 5 and the second metal piece 6 have a cross section of circular, elliptical, arc, square, rectangular and so on. Preferably, the first metal piece 5 has a cross section of a circular shape.

Preferably, the heating surfaces of the two heating panels 1 are arranged opposite to each other.

Preferably, the through groove 13 has a width smaller than that of the accommodating space 12, and both the through groove 13 and the accommodating space 12 are arranged in a rectangular shape.

Preferably, one side of the one of the two heating panels 1 closing to the heating surface 4 has two barrier strips 14.

Preferably, the two barrier strips 14 are located on two sides of the through groove 13.

Preferably, the number of the first metal piece 5 is one, the number of the second metal piece 6 is two, and the two metal pieces 6 are symmetrically located on both sides of the first metal piece 5, respectively.

Preferably, the second metal piece 6 has a step 15 on one side close to the heating surface 4, and the steps 15 on the two second metal pieces 6 are matched with the two barrier strips 14, respectively.

Preferably, one side of the insulator 7 close to the heating surface has two notches, and the two second metal pieces 6 are provided at the two notches, respectively.

Preferably, a side wall of each notch is inclined, a side wall of the second metal piece 6 is inclined, the two inclined planes abut against each other, so that stability of the second metal piece 6 can be guaranteed during its installation process, and movement of the second metal piece 6 towards the side of the heating surface 4 can be avoided.

When the product of the present invention is in use, the hair is clamped between the two heating panels 1. The dryness condition of the hair may affect the resistance values formed between the first metal piece 5 and the second metal piece 6. Hair moisture content is determined upon detection of the resistance values of the first metal piece 5 and the second metal piece 6 by the circuit control system 3, that is, a relative moisture of the hair can be determined by comparing the resistance value of the first metal piece 5 inside the heating panel 1 with a corresponding value set.

It is east to get the hair straightened when it is wet. In this mode, the maximum temperature value is lower, and the corresponding working power is low, achieving the purpose of protecting the hair and straightening the hair; on the contrary, it the hair is dry, a normal mode for dry hair is adopted, the maximum temperature value is higher, and the corresponding working power is normal. According to this relative ratio, the present invention is divided into three corresponding automatic distinguishing working modes. The method is mainly to adjust the power and set the maximum operating temperature internally, so as to effectively help the hair according to the humidity of the hair. The temperature is set according to the resistance value, that is, perming temperature can be automatically adjusted according to the humidity of the hair to protect the hair. A relative value is obtained according to a test value of a sample.

The above-mentioned description are only preferred embodiments of the invention, and it is not thus construed to be limiting the embodiments and scope of the invention.

The invention also has the following implementations based on the above-mentioned embodiments:

in a further embodiment of the invention, please continue to refer to FIGS. 1-5, the circuit control system 3 comprises: a circuit board.

Preferably, the heating surface 4 of the other heating panel 1 is also set to be insulated.

In a further embodiment of the present invention, the hair straightener for automatically distinguishing wet and dry hair further comprises: two handles 21 and two handle covers 22. The two handle covers 22 are installed on an inner side of the two handles 21, respectively, and one of the two handle cover 22 is located at a rear end of the inner side of the handle 21, a heating plate 1 is located at a front end of the inner side of the handle 21, and the other heating plate 1 is located at a front end of the other handle cover 22.

Preferably, the hair straightener for automatically distinguishing wet and dry hair further comprises: two heat insulation sleeves 23, wherein each of the heat insulation sleeves 23 is arranged between each of the heating plates 1 and each of the handles 21.

Preferably, the hair straightener for automatically distinguishing wet and dry hair further comprises: a handle inner sleeve 24, and the handle inner sleeve 24 is arranged between the one of the handles 21, the one of the handle covers 22, and the one of the heating panels 1.

Preferably, the hair straightener for automatically distinguishing wet and dry hair further comprises: a cycle temperature adjustment button 25 and a power button 26, the cycle temperature adjustment button 25 and the power button 26 are electrically connected to the circuit board, respectively.

Preferably, at least two floating pressure springs 27 are provided between the other heating plate 1 and the handle 21.

Preferably, a sealing silica gel 29 is provided in each of the two handles 21, one of the handles 21 is further provided with a light guide sheet 28, and the other of the handles 21 is further provided with a pressing plate 30 and a screw cover 31.

Preferably, a push cover 35 and a push cover pressing plate 36 are further provided in the other of the handles 21.

Preferably, a decorative sheet 37 is further provided in one of the handles 21.

Preferably, the hair straightener for automatically distinguishing wet and dry hair further comprises a junction box 32, a lock ring 33, and a power cord 34 connected in sequence.

The invention is able to adjust temperatures of the heating panels 1 to be in an appropriate range after the humidity of the hair is detected, so that hair caring is in the best state.

The above descriptions are only the preferred embodiments of the invention, not thus limiting the embodiments and scope of the invention. Those skilled in the art should be able to realize that the schemes obtained from the content of specification and drawings of the invention are within the scope of the invention.

What is claimed is:

1. A hair straightener capable of automatically distinguishing dry and wet hair, comprising:

first and second handles, two heating panels disposed within the first and second handle respectively, each of the two heating panels having a heating surface, the two heating surfaces cooperating with each other for clasping hair and for hair styling;

a conduction assembly, provided in one of the two heating panels, and configured to detect the humidity of hair, the conduction assembly comprising at least one first metal piece and at least one second metal piece, wherein the at least one first metal piece is isolated from the at least one second metal piece and the one of the two heating panels, and the at least one second metal piece is in direct contact with the one of the two heating panels;

wherein during use, at least a portion of the at least one first metal piece and at least a portion of the at least one second metal piece are in contact with the hair; and a circuit control system for controlling temperatures of the two heating panels upon receipt of the humidity of the hair detected by the conduction assembly;

wherein the at least one first metal piece and the one of the two heating panels are electrically connected to the circuit control system, the circuit control system determines the humidity of the hair by detecting resistance values between the at least one first metal piece and the at least one second metal piece, and controls the temperatures of the two heating panels.

2. The hair straightener capable of automatically distinguishing dry and wet hair of claim 1, wherein the conduction assembly at least partially penetrates the heating surface of the one of the two heating panels.

3. The hair straightener capable of automatically distinguishing dry and wet hair of claim 1, wherein the conduction assembly further comprises: an insulator, arranged in the one of the two heating panels, between the at least one first metal piece and the at least one second metal piece, wherein the at least one first metal piece is isolated from the at least one second metal piece and the one of the heating panels through the insulator.

4. The hair straightener capable of automatically distinguishing dry and wet hair of claim 1, further comprising at least one thermostat electrically connected to the circuit control system.

5. The hair straightener capable of automatically distinguishing dry and wet hair of claim 1, further comprising two brackets, the two brackets are arranged inside the two heating panels respectively, the two brackets are in contact with the two heating panels, respectively, the bracket in one of the two heating panels is electrically connected to the circuit control system.

6. The hair straightener capable of automatically distinguishing dry and wet hair of claim 1, wherein the circuit control system controls temperatures of the two heating panels in real time upon receipt of the humidity of the hair detected by the conduction assembly.

7. The hair straightener capable of automatically distinguishing dry and wet hair of claim 5, further comprising two heaters, wherein the two heaters are arranged inside the two heating panels respectively, the two heaters are in contact with the two brackets, the two heating panels.

8. The hair straightener capable of automatically distinguishing dry and wet hair of claim 1, further comprising a dry/wet mode selection button, wherein the dry/wet mode selection button is electrically connected to the circuit control system.

* * * * *